United States Patent [19]

Lindström

[11] 4,108,102

[45] Aug. 22, 1978

[54] ANCHORABLE, FLOATING PLATFORM

[75] Inventor: Karl Olof Lindström, Karlskrona, Sweden

[73] Assignee: Karlskronavarvet AB, Karlskrona, Sweden

[21] Appl. No.: 754,267

[22] Filed: Dec. 15, 1976

[30] Foreign Application Priority Data

Dec. 19, 1975 [SE] Sweden ..... 7514420
Nov. 9, 1976 [SE] Sweden ..... 7612441

[51] Int. Cl.[2] ..... B63B 35/44
[52] U.S. Cl. ..... 114/264
[58] Field of Search ..... 114/264, 265, 256, 293, 114/294; 61/86, 98, 100, 101

[56] References Cited

U.S. PATENT DOCUMENTS

| | | | |
|---|---|---|---|
| 2,908,141 | 10/1959 | Marsh, Jr. | 114/293 |
| 2,972,973 | 2/1961 | Thearle | 114/264 |
| 3,289,419 | 12/1966 | McGowen, Jr. | 114/264 |
| 3,708,991 | 1/1973 | Barkley | 114/264 |
| 3,880,102 | 4/1975 | Biewer | 114/264 |

*Primary Examiner*—Trygve M. Blix
*Assistant Examiner*—Jesus D. Sotelo
*Attorney, Agent, or Firm*—Browdy & Neimark

[57] ABSTRACT

An anchorable, floating platform intended to be used for extraction of oil and gas from the bottom of the sea and comprising an upper portion over the water surface, a lower portion under the water surface, and a column which connects the upper portion with the lower portion and which is designed to allow transportation of persons between the two portions. The lower portion is surrounded by a ring of ballast tanks which extend below the lower portion, so that a bowlshaped space is formed between the ballast tanks and the lower portion, and anchor wires are arranged to pass the ring of ballast tanks for holding the platform.

9 Claims, 3 Drawing Figures

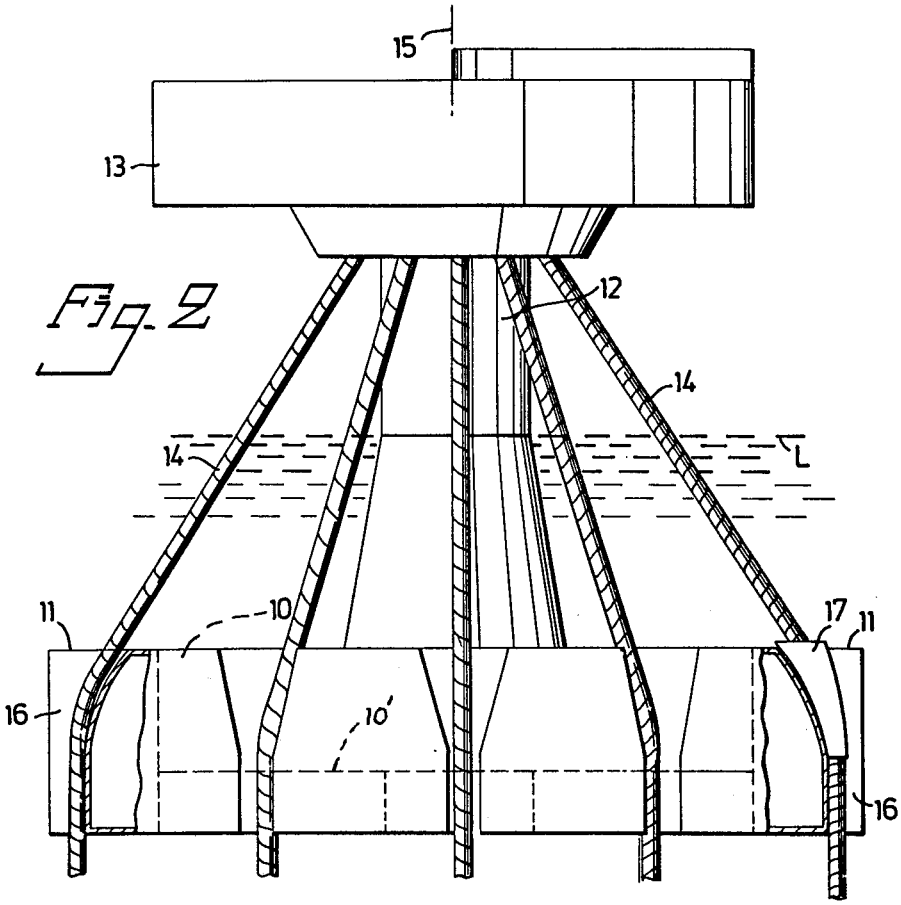
Fig. 2
Fig. 3
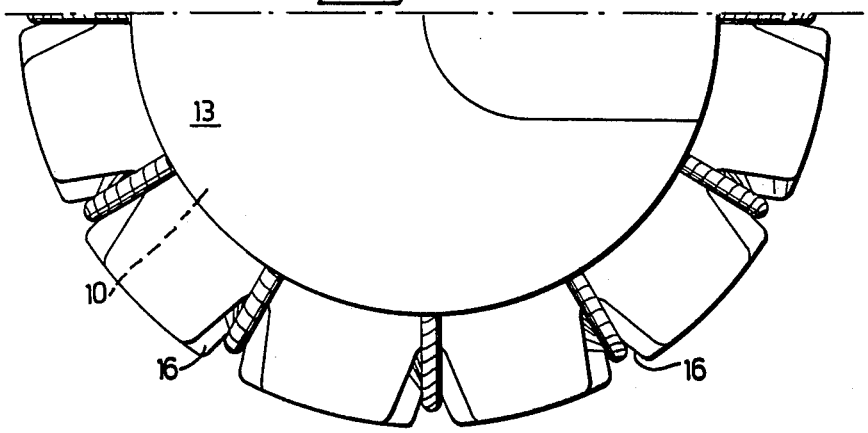

ANCHORABLE, FLOATING PLATFORM

FIELD OF INVENTION

The present invention relates to an anchorable, floating platform which is intended to be used for extraction of oil and gas from the bottom of the sea, i.e. in the offshore engineering field. The platform according to the invention is particularly intended to be used for extraction of natural gas and conversion of this gas into electric current for transfer over electric cables to power stations ashore. The platform comprises an upper portion which is intended to be positioned over the water surface, a lower portion which is intended to be positioned at least to the greater part below the water surface, and a closed column which connects the upper portion with the lower portion and which is designed to allow transportation of persons between the two portions without passage through the water surface.

BACKGROUND

It is previously known to build offshore power stations at the extraction sites of the deposits and to consume the extracted natural gas directly at the extraction site instead of transporting the gas ashore over pipe lines. For this purpose semi-submerged floating platforms are used, and these platforms are held at a constant level over the bottom of the sea by means of a number of vertical wires attached directly to the bottom or to a number of separate anchors. However, it is difficult and time consuming to anchor and stabilize these platforms in such a way that the work necessary for connecting the platforms to cables and pipes can be done rapidly and with the smallest possible risk for the workers who have to carry out the work operations. These work operations include complicated operations to be carried out by divers for the connection and coupling of tubes, pipes and cables at the platforms and at the bottom of the sea. If the divers have to go down into the water from diving ships or platforms, particularly at high sea, they run the risk of hurting themselves on the sides of the ships or platforms. Furthermore, if the platforms are not firmly anchored in relation to the bottom of the sea, it is difficult and dangerous to connect gas conduits or pipes from the bottom of the sea and electric cables with the couplings or connections on the platforms.

SUMMARY

The main object of the invention is, thus, to provide a stable and easily anchorable platform of the type set forth in the introduction which eliminates or at least to a high extent reduces the above mentioned risks and inconveniences.

The necessary stability of the platform has been obtained due to the fact that the ballast tanks extend below the bottom of the lower platform portion so that a bowl shaped space is provided and due to the fact that the anchor wires pass the ring of ballast tanks at its outer portion and firmly hold the ballast tanks and, consequently, also the lower portion of the platform.

Due to the fact that the column between the upper portion of the platform and the lower portion of the platform is designed to allow transportation of persons, it is possible to provide a diving central with a water lock in the lower portion below the water surface so that the divers can enter the water without difficulties or danger also in case of high sea. Furthermore, because the bottom of the lower portion of the platform due to the downwards extending ballast tanks is bowl shaped, it is possible to use pressurized air to force away the water in this space so that the divers can enter into an air cushion and also perform the necessary connection work operations at the platform in this air cushion which to a high extent makes the work of the divers easier and less time consuming. Due to the air cushion it is also easier to provide illumination of the working area by floodlight projectors attached to the bottom of the lower platform portion.

It is also often desirable that a working platform of this type can be detached easily and rapidly from an anchorage and be moved to another position. This is particularly important when the platform is used in or close to arctic waters where large icebergs can appear and, if they hit on such a platform, press down the platform below the water surface or break the anchor wires and the oil and/or gas extraction conduits or pipes which may be connected to the bottom of the sea. Apart from the damages of the platform and the danger for the personnel on board the platform, large oil quantities can be let out and cause severe difficulties or inconveniences with regard to the environment. It is also sometimes necessary to replace a platform by another, for instance for more complicated service operations which have to be carried out in a harbour or which necessitate an interuption of work during a long period of time. Furthermore, an easily movable platform makes it possible to make use of smaller gas pockets and deposits which are not profitable with the present technique. This mobility can be obtained according to a further development of the invention by providing open grooves for the anchor wires in the ballast tanks.

A further advantage of the platform according to the invention is that the design of the platform is comparatively simple and, thus, less expensive than the present designs.

BRIEF DESCRIPTION OF DRAWINGS

Two embodiments of the invention shall now be described below with reference to the attached drawings.

FIG. 2 is a schematic view of a slightly modified platform according to the invention.

FIG. 3 is a schematic view from above of the lower portion of the platform shown in FIG. 2.

DETAILED DESCRIPTION OF EMBODIMENTS

Figure 1:
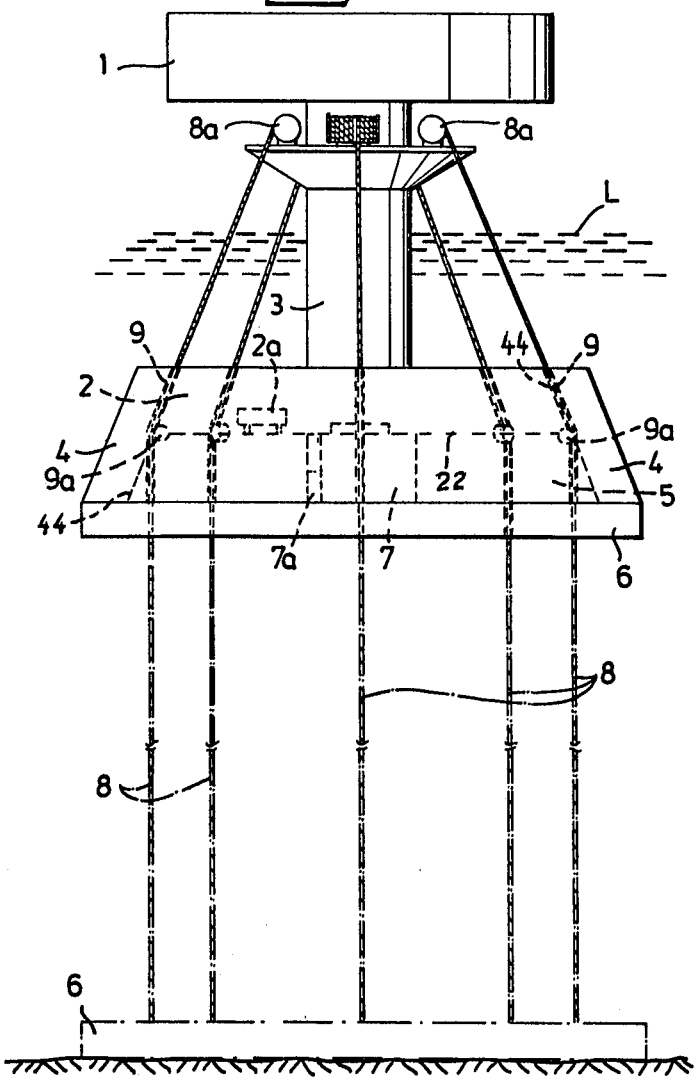
FIG. 1 is a schematic side view of a platform according to the invention.

The platform shown in FIG. 1 comprises an upper machine house 1 which contains turbines, generators, filters and so on (not shown) and is built on a deck at a safe height over the water surface. The roof of the machine house can be designed as a helicopter platform. Below the upper machine house and submerged into the water, there is a lower machine house 2 which contains an air compressor 2*a* for generation of pressurized air and also contains transformers with the pertaining devices (not shown) for transfer of current, for instance high voltage direct current, over a cable to land. The upper machine house 1 and the lower machine house 2 are connected by means of a vertical column 3 which is designed as a hollow cylinder and allows transportation of persons within the cylinder between the two machine houses. In the operating position, the lower machine house 2 and substantially half the column 3 are submerged into the water, as indicated by the dash-dotted waterline L of FIG. 1.

The lower machine house 2 is surrounded by a ring of ballast tanks 4, having an interior wall 44, the ballast tanks extending below the bottom 22 of the machine house 2, so that a bowl shaped space 5 is provided between the sides of the ballast tanks and the bottom of the lower machine house. This space is used for forming an air cushion by blowing pressurized air through a conduit (not shown) from the compressor 2*a* into the space. The air cushion makes the diving operations easier, as already mentioned, and is also a complement for variation of the draught and trim of the platform and, thus, facilitates the stabilization of the platform. The air cushion is divided into portions by means of partitions or bulkheads for increasing the stability of the platform. Furthermore, a diving central 7 from which a lock 7*a* (schematically shown) leads to the bowl shaped space is provided under the lower machine house 2.

Due to the presence of the air cushion, the draught and the trim of the platform can be adjusted also with empty ballast tanks. The fixed volume deplacement can therefore be reduced which is an advantage for a platform the lower portion of which is to be submerged under the water surface at the same time as it is desirable to have a low draught during transportation.

An anchor 6 of concrete which can be dropped to the bottom, as indicated by the dash-dotted lines of FIG. 1, is provided under the ballast tanks 4. The anchor is designed as a ring which is suspended under the ballast tanks in a number of vertical wires 8. The anchor wires run over pulley wheels 9*a* and through tubes 9 in the ballast tanks up to windlasses or winches 8*a* which are positioned on a platform below the upper machine house. These wires can also be used as guides for a lifting platform for divers.

The anchor has a double function. Apart from holding the platform in right position, by means of stretched wires, it also holds the platform at a constant level over the bottom under all circumstances. The matching to the slope of the sea bottom is provided by individual control of the windlasses.

The embodiment of the platform shown in FIG. 1 in the operation position has a draught of about 35 meters including the lifted anchor.

The modified platform shown in FIG. 2 comprises a lower portion 10 having a bottom wall 10′ which is circular in the horizontal plane and which is provided with a number of ballast tanks symmetrically positioned around its periphery. In the centre of the lower portion there is a vertical column 12 carrying a working platform 13 which is positioned above the water surface and on which the equipment necessary for performing the different working operations can be placed. This equipment can include winches, cranes and other machines which are not shown on the drawings, because they are not related to the invention. The necessary equipment can also be placed within the column 12 or in special spaces in the portion 10 which is submerged into the water. The column 12 is so designed that it allows transportation of personnel to and from the lower portion 10. The ballast tanks 11 extend below the lower portion 10 and form a bowl shaped space together with the portion 10. In this space an air cushion can be provided in the same way as in the previously described embodiment.

The platform is anchored by means of a number of anchor wires 14 which are attached to or at the bottom of the sea and which can be tensioned by means of a number of winches or similar devices positioned on the upper portion of the platform.

The wires are attached to the platform relatively close to the vertical centre line 15 of the platform and run outwards and downwards over the periphery of the lower portion 10 to the fastening points at the bottom of the sea. The fastening points can be attachments on a special anchor or lugs or rings directly fastened in the bottom. When passing over the lower portion 10, the wires run in substantially vertical, open grooves 16 equally spaced along the periphery of the portion 10. At their upper portions, these grooves are curved towards the vertical centre line 15 of the platform, so that the wires 14 run in curved paths at the upper edge of portion 10. As shown in FIG. 3, the grooves 16 become narrower towards the centre of platform 10, the dimensions matching the diameter of the wires in such a way that the grooves at the outer end have a width which is larger than the diameter of the wires and at the inner end have a width which is smaller than the diameter of the wires. By this feature is obtained that the wires, when the tension in the wires increases, are pressed into the grooves and are wedged against the side walls of the grooves, so that the wires are locked in relation to the ballast tanks 11 and the portion 10. The grooves are wedge-shaped in the vertical plane, as also shown in FIG. 3, the broader part being positioned at the upper edge of portion 10. The wedge-shape makes it possible for the grooves to co-operate with stop means 17 having a corresponding wedge-shape and being attached to the wires. One such stop means is shown in FIG. 2. These stop means are adjustable with regard to the height and arranged to wedge into the grooves when portion 10 moves upwards in relation to the wires. When detaching the platform, the wedges can be pulled out of the grooves by means of the wire winchs positioned on the platform.

When a platform according to the invention is to be anchored, a certain quantity of water is first entered into the ballast tanks, so that the platform floats with a normal draught. The platform is then positioned on the determined anchorage, where the anchor wires are supposed to be already attached to the bottom or to an anchor positioned on the bottom, and is connected to the wires. By means of the winches, the lengths of the wires are matched after the water depth on the anchorage, and the wires are then tensioned, so that the column of the platform is substantially vertical. When all the wires have been equally tensioned, the tensioning is further increased by pumping out a convenient quantity of ballast water. When doing so, the wires have to be locked in relation to the lower portion to the platform. In this way a safe holding of the platform and a substantially increased stability is obtained rapidly and easily, provided that the tension in the wires is sufficient for ensuring that the platform is kept at a constant level over the bottom of the sea under all possible weather conditions.

When detaching the platform from the anchorage, water ballast is first let in, until the wires are loosened. The wire stop means, if any, can then be pulled out of the wire grooves by means of the winches and the wires can then be moved radially out of the grooves. The wires can then be disconnected from the winches and the ends of the wires, when disconnected from the winches, can be attached to one or more floating bodies, so that later the wire ends easily can be located, when it is again desirable to anchor a platform on the site. When the wire ends have been disconnected from the platform, the platform is free and can be moved from the place.

After the anchoring procedure, the platform is connected to conduits and electric cables lying on the bottom of the sea, if necessary for the work to be performed. Before the detaching of the platform, these conduits or electric cables have to be disconnected.

Apart from an easier and more rapid anchoring and detaching procedure, the invention gives the advantage that, due to the locking of the wires in the grooves, the forces in the anchor wires to a large extent are taken up by the lower portion of the platform so that the winches, the winch platform and the upper portion of the wires are relieved. Therefore, these parts can be designed for lower stresses which results in lower weight, increased stability and lower costs.

I claim:

1. Anchorable, floating platform for extraction of oil and gas from the bottom of the sea, comprising an upper portion which is over the water surface; a lower portion which is at least to the greater part submerged into the water surface; a closed column connecting the upper portion with the lower portion and allowing internal transportation of persons between the two portions; a ring of ballast tanks provided on the lower portion; means to stabilize the platform wherein said ring of ballast tanks extends below the bottom of the lower portion, so that a bowl-shaped space open at the bottom is formed by the ballast tanks and the bottom of the lower portion; means for blowing pressurized air at superatmospheric pressure into the bowl-shaped space under the bottom of the lower portion for forming an air cushion under the lower portion; and anchor wires passing the ring of ballast tanks.

2. Platform according to claim 1, in which the bowl-shaped space is divided into a number of sections, so that the air cushion comprises a number of portions for increasing the stability.

3. Platform according to claim 1, in which a diving central is provided in the bowl-shaped space under the bottom of the lower portion and is provided with a water lock for passing into and returning from the water.

4. Platform according to claim 1, in which the wires pass through tubes in the ballast tanks and over pulley wheels on the lower portion up to winches on the upper portion.

5. Platform according to claim 1, said ring of ballast tanks comprises substantially vertical grooves on the outer surface thereof for the passing thereover of said anchor wires, said grooves being arranged for holding said wires.

6. Platform according to claim 5, wherein said grooves at their upper ends are curved toward the center of said lower portion.

7. Platform according to claim 6, wherein said grooves are V-shaped in cross section, so that the wire is locked in the groove, when the wire is tensioned.

8. Platform according to claim 5, wherein said grooves are wedge-shaped in the vertical plane, the broader portion being arranged at the upper end; and further comprising stop means fastened on each wire, said stop means being complementary in shape to the wedge-shaped grooves, so that the stop means are locked in the grooves, when the lower portion of the platform moves upwards in relation to the wires.

9. Platform according to claim 5, wherein said lower portion has a substantially round form in the horizontal plane and said grooves are uniformly distributed along the periphery of the lower portion of the platform.

* * * * *